United States Patent [19]

Szlucha

[11] 4,324,482

[45] Apr. 13, 1982

[54] PRESSURE ROLL CLEANING DEVICE

[75] Inventor: Thomas F. Szlucha, Fairport, N.Y.

[73] Assignee: Xerox Corporation, Stamford, Conn.

[21] Appl. No.: 210,966

[22] Filed: Nov. 28, 1980

[51] Int. Cl.[3] ..... G03G 15/00; F27B 9/28

[52] U.S. Cl. ..... 355/3 FU; 355/14 FU; 355/15; 15/256.52; 432/75; 118/652

[58] Field of Search ..... 355/15, 3 FU, 14 FU, 355/30 D, 14 DD; 430/125; 118/652, 661, 70; 432/60, 75; 15/256.51, 256.52

[56] References Cited

U.S. PATENT DOCUMENTS

| | | | |
|---|---|---|---|
| 3,080,688 | 3/1963 | Politzer | 51/185 |
| 3,510,903 | 5/1970 | Stoever et al. | 355/15 |
| 3,617,123 | 11/1971 | Emerson | 355/15 |
| 3,649,992 | 3/1972 | Thettu | 15/256.52 |
| 3,941,558 | 3/1976 | Takiguchi | 355/15 X |
| 4,252,435 | 2/1901 | Manghirmalani | 355/15 |
| 4,277,161 | 7/1981 | Calabrese | 355/3 FU |
| 4,285,090 | 8/1981 | Jurkowski | 15/256.51 |

*Primary Examiner*—Arthur C. Prescott

[57] ABSTRACT

Roll fuser apparatus and cleaning structure therefor. The cleaning structure is characterized by the provision of a pad supported in rubbing contact with the backup roll of the roll fuser apparatus. The pad is constructed so that approximately 75% of its total volume is made of intercommunicated voids so that toner removed from the backup roll can move freely therethrough and not agglomerate at the surface of the pad as in the case of prior art devices. In one embodiment of the invention the back surface of the pad is unobstructed to allow toner to actually move out of the pad thereby increasing the useful cleaning life of the pad.

4 Claims, 2 Drawing Figures

PRESSURE ROLL CLEANING DEVICE

BACKGROUND OF THE INVENTION

This invention relates generally to xerographic copying apparatus and, more particularly, to a contact fusing system and cleaning mechanism therefor for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photsensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material become tacky and coalesce. This action causes the toner to be absorbed to some extent into the fibers of the support member which, in many instances, contitutes plain paper. Thereafter, as the toner material cools, solidification of the toner material occurs causing the toner material to be firmly bonded to the support member. In both the xerographic as well as the electrographic recording arts, the use of thermal energy and the simultaneous application pressure for fixing toner images onto a support member is old and well known.

One approach to this type fusing of electroscopic toner images onto a support has been to pass the support with the toner images thereon between a pair of pressure engaged roller members, at least one of which is interally heated. During operation of a fusing system of this type, the support member to which the toner images are electrostatically adhered is moved through the nip formed between the rolls with the toner images contacting the heated roll to thereby effect heating of the toner images within the nip. By controlling the heat transferred to the toner, virtually no offset of the toner particles from the copy sheet to the fuser roll is experienced under normal conditions. This is because heat applied to the surface of the roller is insufficient to raise the temperature of the surface of the roller above the "hot offset" temperature of the toner whereat the toner particles in the image areas of the toner would liquify and cause a splitting action in the molten toner to thereby result in "hot offset". Splitting occurs when the cohesive forces holding the viscous toner mass together are less than the adhesive forces tending to offset it to a contacting surface such as fuser roll.

However, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particle can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon (Trademark of E. I. Dupont), to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface. Also, stripping of the copy sheets from the fuser roll is facilitated. The foregoing notwithstanding, "non-visual offsetting" (i.e. offsetting of very fine particles of toner) does occur. In prior art constructions (fuser structures where the outer surface comprises Teflon or silicone rubber) such offsetting has been combated by the employment of various cleaning members, the wick material employed for applying the silicone based oil to the fuser roll serving this purpose.

Toner which is picked up by the backup roll, in whatever manner, is conventionally removed therefrom by means of a Nomex or similar type cleaning pad supported in rubbing contact with the backup roll. Nomex is a trademark of E. I. Dupont for a heat resistant nylon comprising the copolymer of meta-phenylenediamine and isophtalozl chloride. The backup roll comprises an unheated roll having a relatively thick layer of silicone rubber bonded to a core and having a sleeve of Teflon thereover. It is believed that the toner is readily removed from the Teflon outer surface of the backup roll by means of the Nomex pad due to the presence of copious amounts of silicone oil transferred to the backup from the heated fuser roll.

In the interest of improving at least the perceived copy quality of fixed toner images on plain paper, Teflon coated fuser rolls have given way to ones which are coated with a relatively thick layer of silicone rubber. Such rolls used in conjunction with a much harder backup roll have come to be referred to as Nip Forming Fuser Roll (NFFR) fusers.

Using the aforementioned Nomex cleaning pads in NFFR fusers for removing toner from the backup roll, it was found, required the application of higher loads in order to produce acceptable cleaning of the backup roll. While the cleaning was acceptable, it appeared that the higher loading employed adversely affected the wear rate and, therefore, the useful life of the pad. Moreover, due to the physical makeup (i.e. tightly packed fibers) of the pad the toner became imbedded in the surface of the pad thereby adding to the shortening of the useful life of the pad for the purpose of cleaning toner from the backup roll.

SUMMARY OF THE INVENTION

The present invention provides an improved method of cleaning or removing toner material from the surface of a backup roll and thus an improved fuser apparatus is provided. To this end, a cleaning pad is provided which unlike those previously used comprises fibers which are not tightly packed and, therefore, the volume of the pad is made up of intercommunicated voids representing about 75% of the total volume of the pad.

In the various embodiments of the invention, the pad is supported for rubbing contact with the roll to be cleaned. Due to the rather large percentage of the pad's open volume it can collect a large quantity of toner before it has to be replaced. In one embodiment of the invention the pad's useful life is substantially increased by supporting the pad such that the surface (i.e. rear surface or bottom) thereof opposite the area contacting the roll surface is unobstructed. Accordingly, the toner can move completely through the pad and be collected in an area adjacent that surface.

The pad is designed to contact the roll over an area equal to one and a half by fifteen inches. A loading force of two to five pounds is employed for creating the desired rubbing contact between the roll and the pad. While the pad is compressible the aforementioned loading is insufficient to cause compression thereof thereby insuring that the useful volume of the pad is not diminished.

DESCRIPTION OF THE PREFERRED EMBODIMENTS OF THE INVENTION

Figure 1:
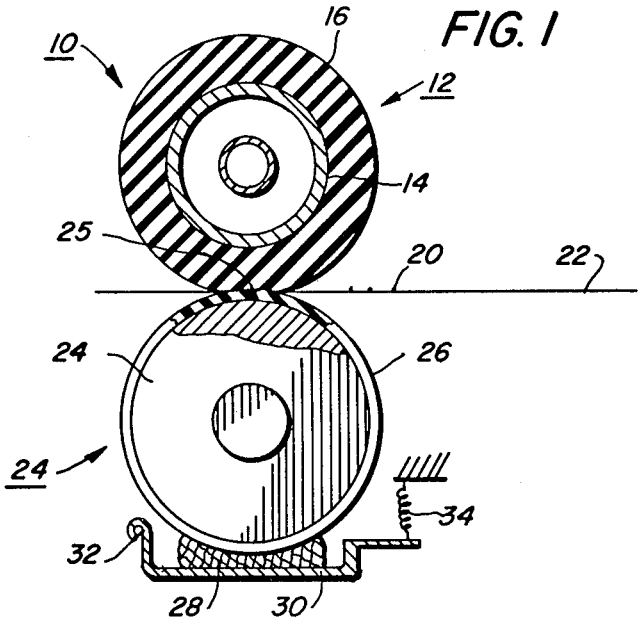
FIG. 1 is a side elevational view of a roll fuser apparatus of the present invention.

Illustrated in FIG. 1 is a roll fuser apparatus generally indicated by reference character 10. The apparatus comprises a heated fuser roll 12 including a cylinder 14 fabricated from a thermally conductive material such as copper. Adhered to the cylinder 14 is a relatively thick (i.e., about 60 mils) layer 16 of an elastomeric material which is preferably silicone rubber. A source of thermal energy in the form of a quartz lamp 18 is supported in a well known manner within the cylinder 14. The lamp 18 serves to elevate the temperature of the surface of the layer 12 to enable fusing of the toner images 20 to copy substrates 22.

The roll fuser apparatus 10 also comprises a backup or pressure roll 24 including a tubular support member 24 coated with a layer 26 of adhesive material such as polytetrafluorethylene or a copolymer of perfluoroalkyl perfluorovinyl ether with tetrafluoroethylene, said ether having the formula $C_nF_{2n+1}-0-CF=CF_2$ wherein n is a number from 1 to 5. The rolls 12 and 24 are pressure engaged in a well known manner to form a nip 25 through which the copy substrates 22 pass with the toner images 20 contracting the heated fuser roll 12.

A release agent management (RAM) system (not shown) serves to apply silicone oil to the surface of the fuser roll 12 in order to facilitate stripping of the copy substrates 22 and to minimize toner offsetting to the fuser roll 12.

Toner offset to the backup roll 24 is removed therefrom by means of a pad 28 supported in rubbing contact with the surface of the backup roll 26. To this end there is provided a relatively rigid support 30 which is pivotally carrried by one end by a pin 32 and which is spring biased in the direction of the roll 24 by means of a spring 34.

The pad 28 comprises a lofty, open nonwoven compressible fibrous abrasive member. Such a pad is formed from a uniform lofty open nonwoven lightweight web of many interlaced randomly disposed flexible durable tough organic fibrous members (e.g., nylon fibers). The lofty fibrous web is unified preferably by an organic binder which bonds web fibers firmly together at points where they intersect and contact one another. Distributed within the web and firmly bonded to the fibrous members thereof are abrasive particles, the many interstices between adjacent fibers remaining substantially unfilled by adhesive and abrasive particles so that at least about 75% of the total volume of the pad is made up of a tridimensionally extending network of intercommunicated voids. Pads of this type are described in U.S. Pat. No. 3,080,688 granted Mar. 12, 1963 to Hoover et al.

Other nonwoven fibrous web structures may also be employed, it being generally desirable for the web to have a bulk density between 0.05 and 0.2 gram per cubic centimenter and that the web fibers have a thickness between 5 and 50 denier. The shape and thickness of the pad may be designed to suit the particular fuser apparatus in which it is used. It is contempleted that thickness will vary between $\frac{1}{8}$ to $\frac{1}{2}$ inch and preferably will be about $\frac{1}{4}$ inch.

The spring 34 is designed to apply a loading force between the pad and the roll surface on the order of two to five pounds with the contact area being on the order of one and one half by fifteen inches. Although the pad, due to its inherent nature is compressible, the aforementioned loading force is designed to minimize any change in bulk density, porosity and abrasiveness of the pad to thereby prevent diminishing the pad's effectiveness in the manner used.

Figure 2:
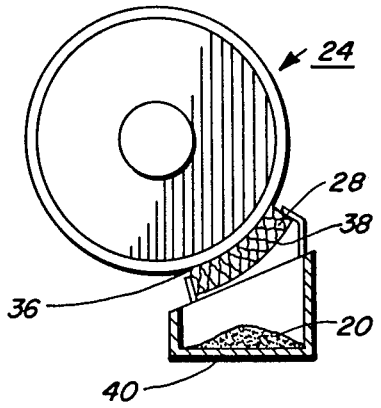
FIG. 2 is a side elevational view of a backup roll of a fuser apparatus and a cleaning structure therefor representing a modified form of the invention illustrated in FIG. 1.

As shown in FIG. 2, a surface 36 of the pad 28 is supported in contact with the pressure roll 24 such that the opposite surface 38 is unobstructed as it is in the embodiment illustrated in FIG. 1. Accordingly, the toner 20 removed from the surface of the roll 24 can pass completely through the pad 28, exiting from the surface 38 and falling into a receptacle 40 provided for that purpose.

I claim:

1. Roll fuser apparatus comprising:

a heated fuser roll;

a backup roll cooperating with said fuser roll to form a nip through which copy substrates carrying toner images pass with the toner images contacting said heated fuser roll;

a cleaning pad;

means for supporting said cleaning pad in rubbing contact with said backup roll for removing toner therefrom, said pad being constructed such that about 75% of its total volume is made up of intercommunicated voids whereby the removed toner can freely pass into and through the pad.

2. Apparatus according to claim 1 wherein said pad is supported such that the surface thereof opposite the one contacting said backup roll is unobstructed whereby toner passing through said pad can pass out of said pad.

3. Apparatus according to claims 1 or 2 including means for applying a loading pressure between said pad and said backup roll, said loading pressure being insufficient to cause compression of said pad.

4. Apparatus according to claim 3 wherein said loading pressure is on the order of 3–5 pounds over an area of 22.5 inches.

* * * * *